US012071824B2

(12) United States Patent
Jones

(10) Patent No.: US 12,071,824 B2
(45) Date of Patent: Aug. 27, 2024

(54) MILLING TOOL

(71) Applicant: Tenax Energy Solutions, LLC, Clinton, OK (US)

(72) Inventor: Kevin Dewayne Jones, Clinton, OK (US)

(73) Assignee: Tenax Energy Solutions, LLC, Clinton, OK (US)

( * ) Notice: Subject to any disclaimer, the term of this patent is extended or adjusted under 35 U.S.C. 154(b) by 0 days.

(21) Appl. No.: 17/338,844

(22) Filed: Jun. 4, 2021

(65) Prior Publication Data

US 2021/0381329 A1 Dec. 9, 2021

Related U.S. Application Data

(60) Provisional application No. 63/034,744, filed on Jun. 4, 2020.

(51) Int. Cl.
*E21B 29/00* (2006.01)
*E21B 23/14* (2006.01)

(52) U.S. Cl.
CPC ..... *E21B 29/002* (2013.01); *E21B 23/14* (2013.01)

(58) Field of Classification Search
CPC ..... E21B 29/005; E21B 23/14; E21B 29/002
See application file for complete search history.

(56) References Cited

U.S. PATENT DOCUMENTS

| | | | | |
|---|---|---|---|---|
| 6,378,632 | B1 * | 4/2002 | Dewey | E21B 10/61 175/269 |
| 2016/0237752 | A1 | 8/2016 | Jones | |
| 2018/0156033 | A1 * | 6/2018 | Hempel | E21B 10/322 |
| 2018/0266186 | A1 * | 9/2018 | Burca | E21B 10/46 |
| 2020/0149365 | A1 * | 5/2020 | Wilson | E21B 29/005 |
| 2021/0340830 | A1 * | 11/2021 | Hallundbæk | E21B 29/005 |

* cited by examiner

*Primary Examiner* — Christopher J Sebesta
(74) *Attorney, Agent, or Firm* — Tomlinson McKinstry, P.C.

(57) ABSTRACT

A milling tool for use in a cased wellbore. The milling tool has a housing having a plurality of pockets formed therein. A blade is installed within each pocket and is movable between open and closed positions. The blade projects from the pocket when in an open position. Rotation of the housing causes the blades to move to an open position. The blades remain in a closed position when the housing is not rotating.

1 Claim, 17 Drawing Sheets

MILLING TOOL

SUMMARY

The present invention is directed to an apparatus comprising a downhole milling tool. The milling tool comprises a housing having an outer surface and at least one pocket formed therein, and a blade installed within the pocket and movable relative to the housing between open and closed positions. The blade is disposed within the pocket when in the closed position, and projects from the outer surface of the housing when in the open position.

DETAILED DESCRIPTION

Figure 1:
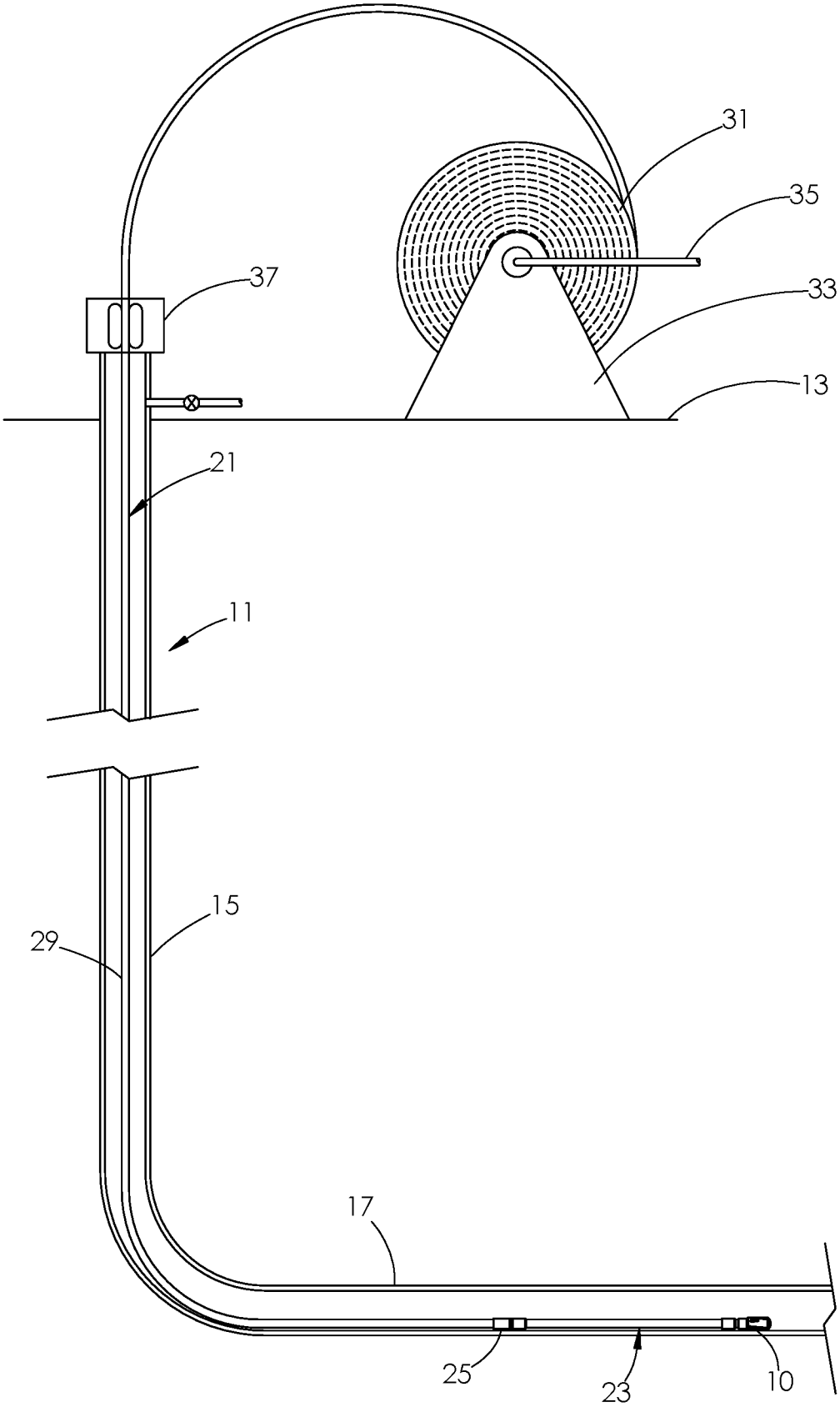
FIG. 1 is an illustration of a milling system installed within an underground cased wellbore.

Turning to FIG. 1, during oil and gas drilling operations, a wellbore 11 is drilled beneath a ground surface 13 and a casing 15 is installed within the wellbore 11. The wellbore 11 may extend vertically and transition into a horizontal section 17. A tubular work or drill string 21 is shown installed within the casing 15. The tubular string 21 is known in the art as "coiled tubing". Coiled tubing is typically used in well completion or workover operations to lower tools into the wellbore 11. The tools are typically included in a bottom hole assembly (BHA) 23 attached to a first end 25 of the string 21.

The tubular work string 21 is a long metal pipe that is typically between one and four inches in diameter. A first portion 29 of the string 21 is situated within the casing 15 and a second portion 31 is wound around an above-ground reel 33. A second end 35 of the string 21 is supported on the reel 33. No opening is formed within the string 21 between its opposed first and second ends 25 and 35. In operation, the string 21 is unwound from the reel 33 and lowered into the casing 15 to the desired depth. An injector head 37 positioned at the ground surface 13 grips and thrusts the string 21 into the wellbore 11. In alternative embodiments, the tubular work string 21 may comprise jointed pipe, instead of coiled tubing.

Continuing with FIG. 1, a milling tool 10 is attached to the front end of the bottom hole assembly 23. Milling tools are used to grind up tools or obstructions, such as large composite plugs or other equipment, abandoned within the wellbore 11 during drilling and fracturing operations. Once the obstruction is ground into small pieces, the pieces may be flushed from the casing with pressurized fluid. The milling tool 10 is rotated by a downhole motor, such as a mud motor, included in the bottom hole assembly 23.

Milling tools known in the art are known to interfere with the walls of the casing 15 as the tool is lowered down or removed from the casing 15. Such interference may cause the tool to become stuck in the casing 15. If the tool becomes stuck, operations must be halted while the tool is dislodged, costing valuable time and money. The present disclosure is directed to a milling tool 10 configured to not interfere with the walls of the casing 15 when being lowered down or removed from the casing 15.

Turning to FIGS. 2-7, the milling tool 10 comprises a blade housing 12 joined to a connection member 14 by a body section 16. The milling tool 10 may be attached to the bottom hole assembly 23 via the connection member 14. A plurality of blades 18 are housed within the blade housing 12. In operation, rotation of the milling tool 10 rotates the blades 18. Equipment found within the casing is ground into small pieces when contacted by the rotating blades 18.

Figure 2:
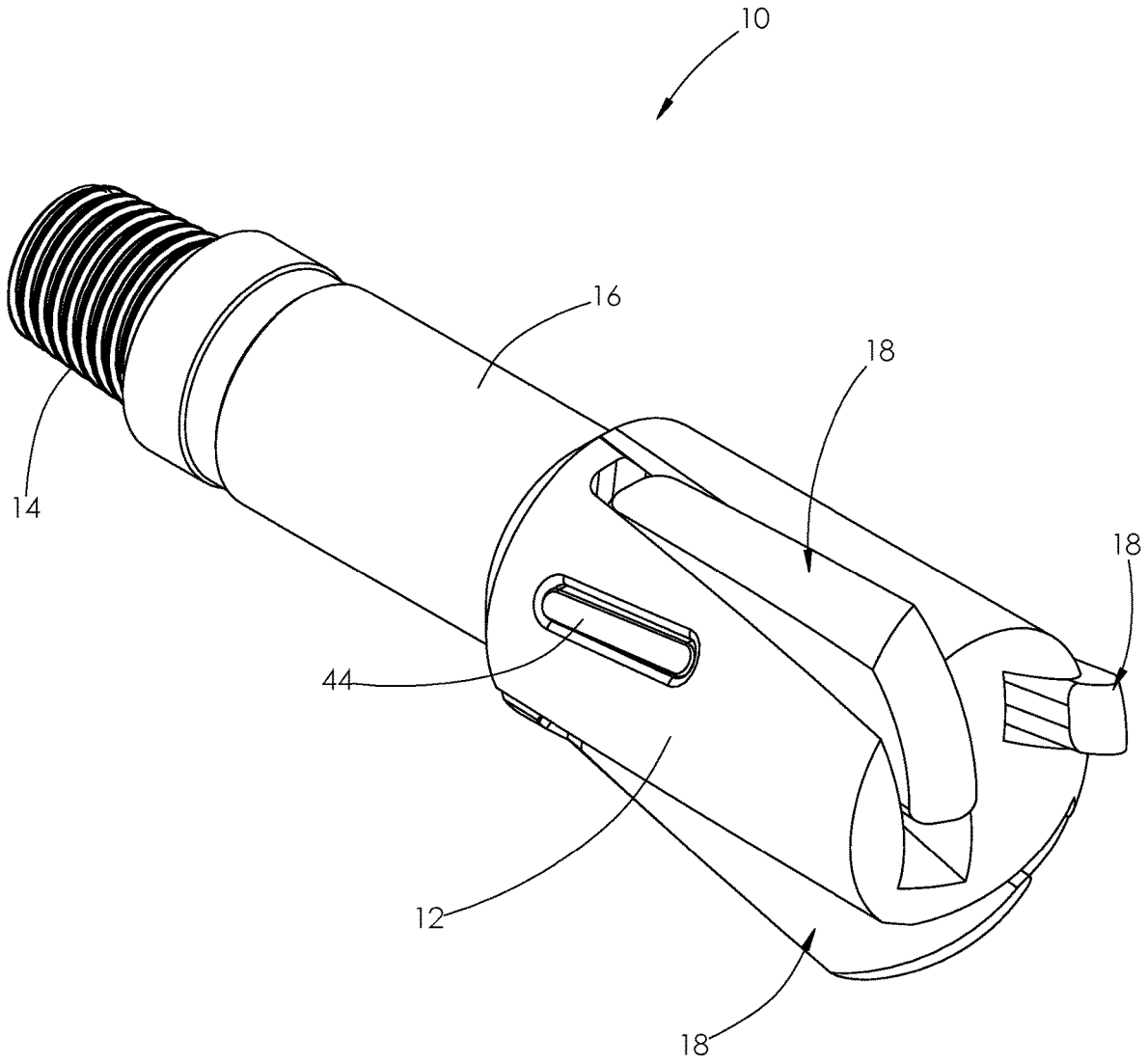
FIG. 2 is a front perspective view of a milling tool. A plurality of blades included in the milling tool are shown in an open position.
Figure 3:
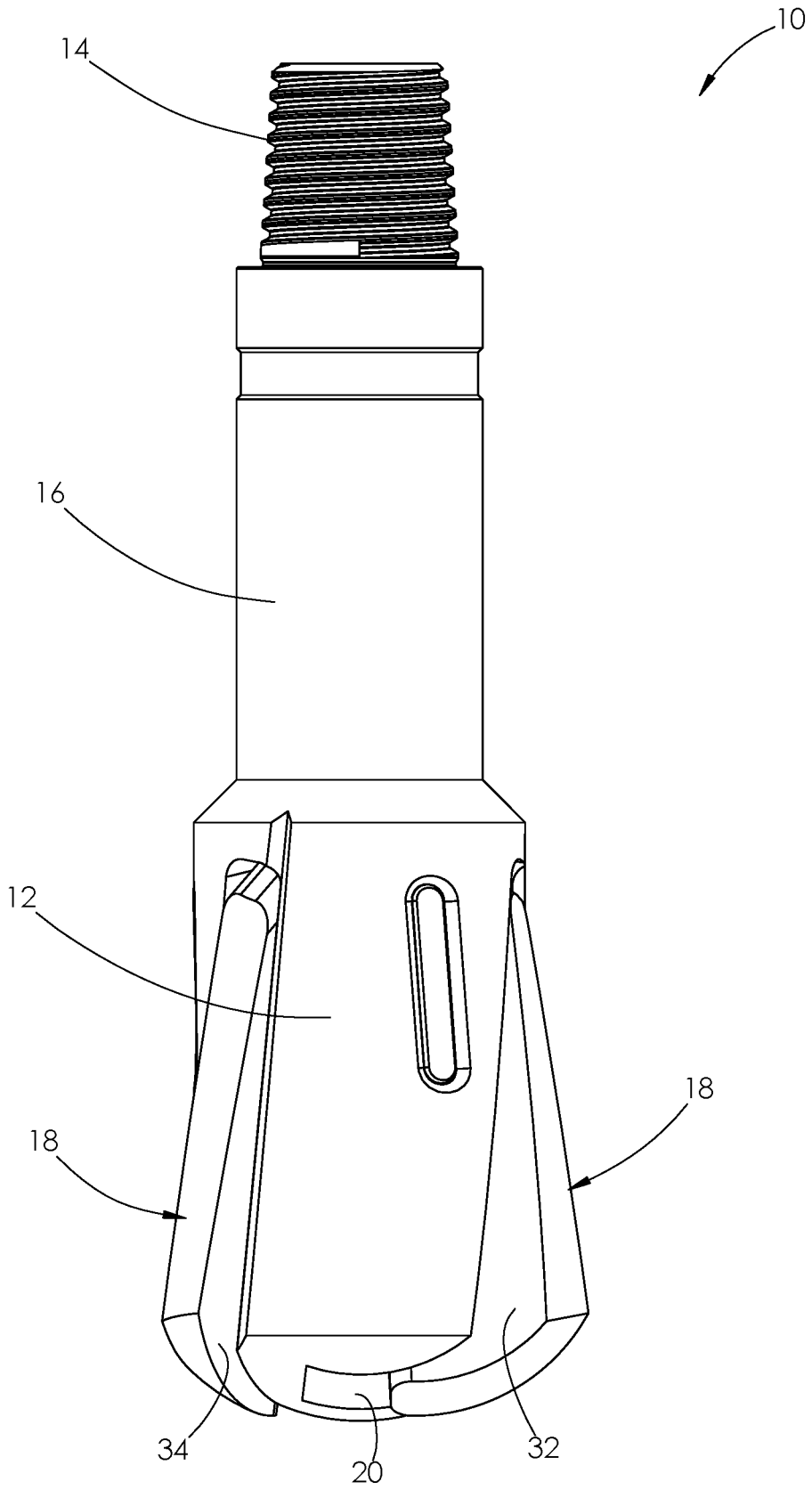
FIG. 3 is a top plan view of the milling tool shown in FIG. 2.

As will be described in more detail herein, the blades 18 may move between an open position, shown in FIGS. 2-4, and a closed position, shown in FIGS. 5-7. The blades 18 are in the closed position when the tool 10 is being lowered down the casing. The blades 18 are in the open position when the tool 10 is rotated by the downhole motor included in a BHA.

Figure 8:
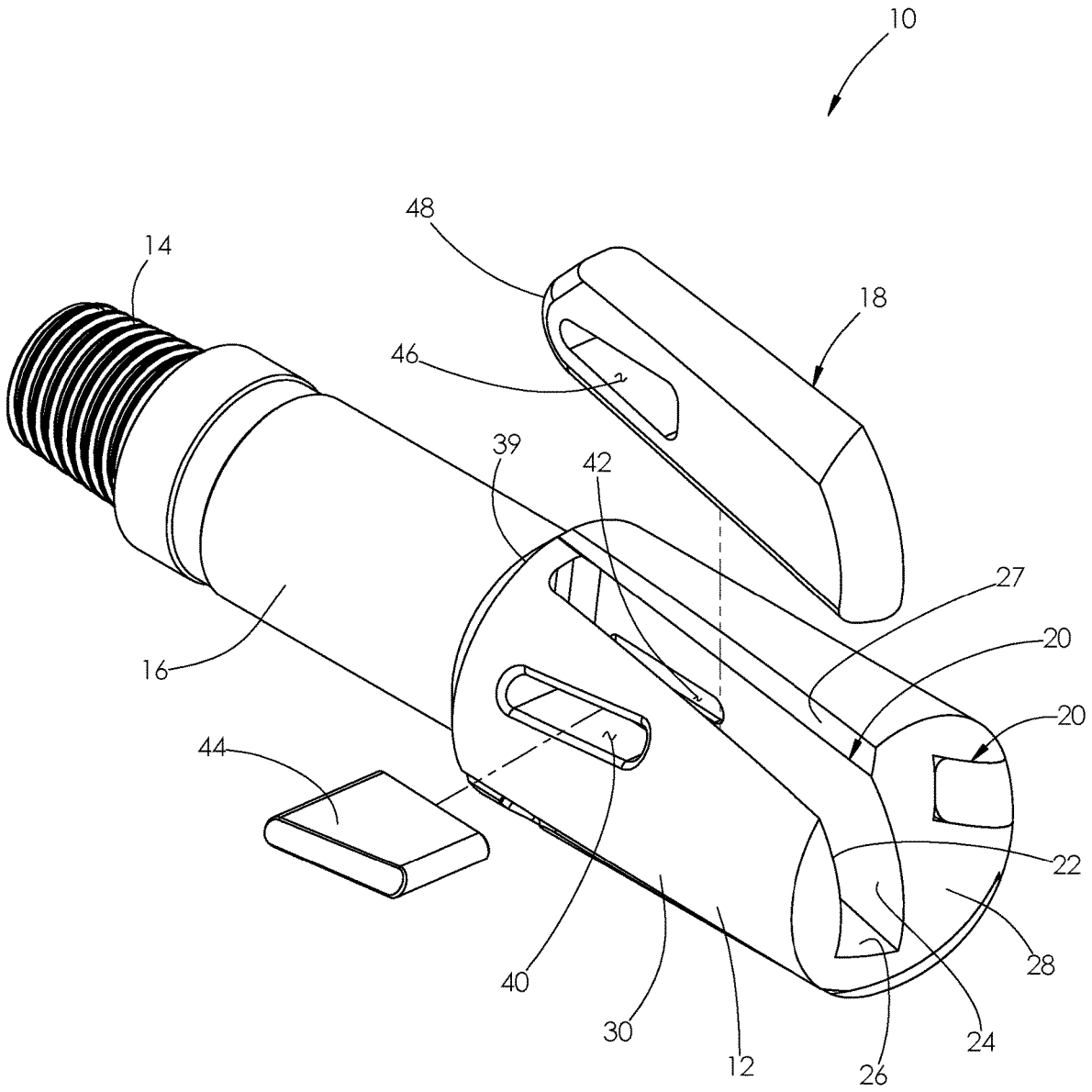
FIG. 8 is the same view of the milling tool as shown in FIG. 5, but one of the blades is shown exploded from the tool.
Figure 9:
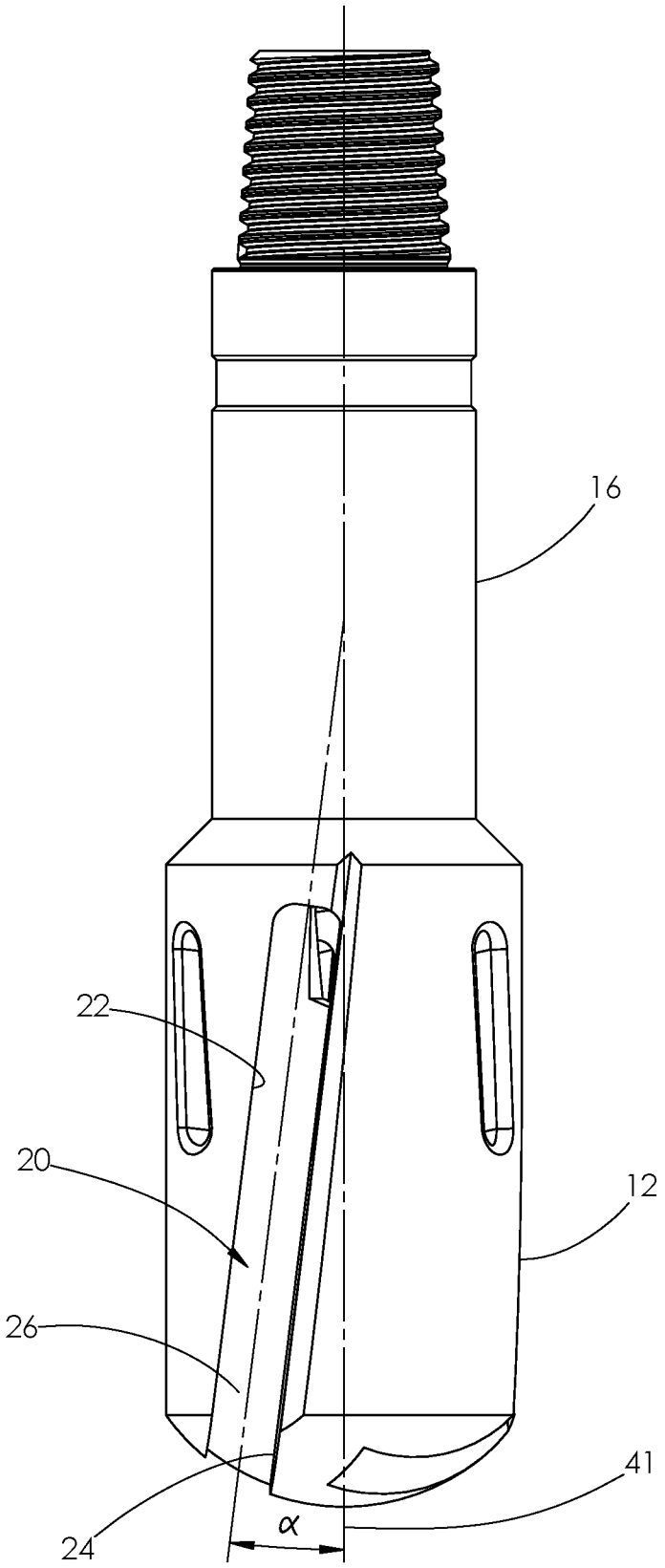
FIG. 9 is a top plan view of the milling tool shown in FIG. 2, but the blades have been removed.
Figure 9A:
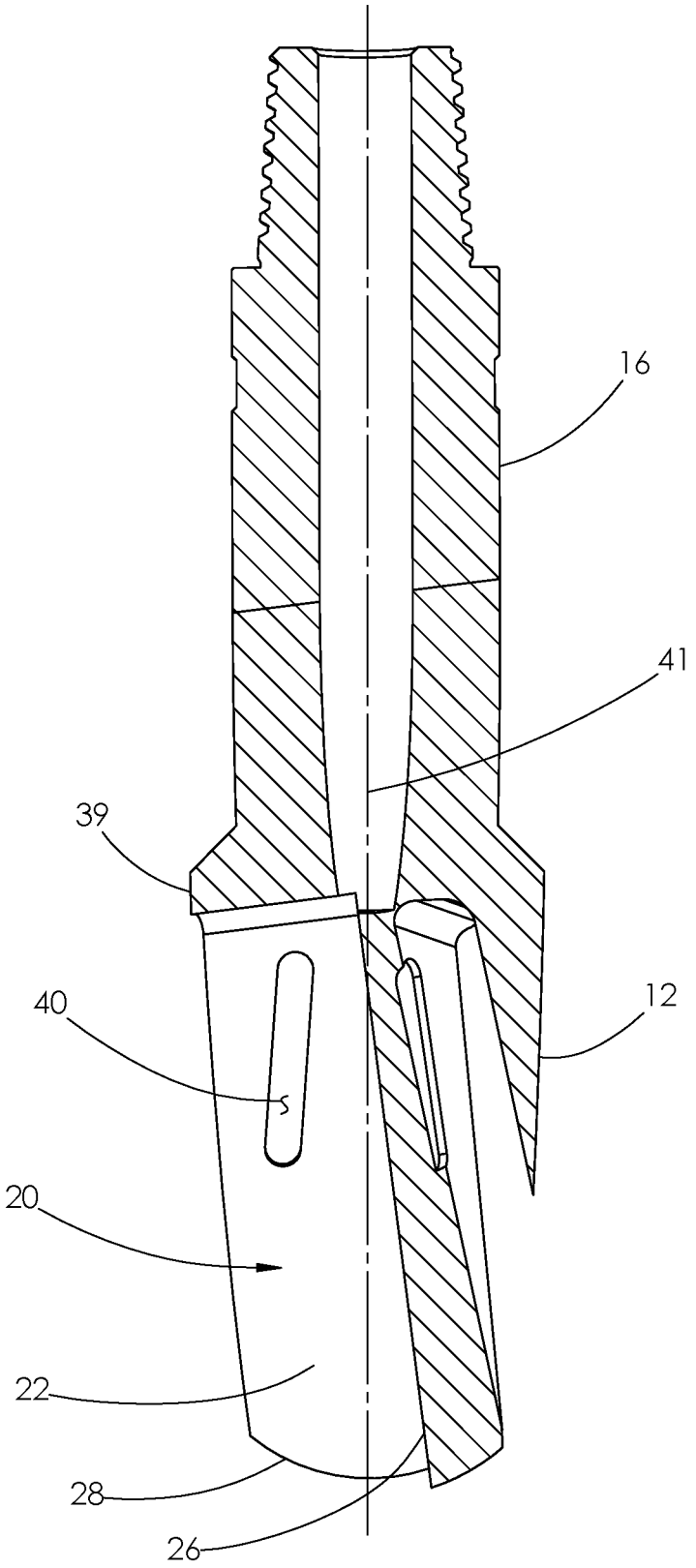
FIG. 9A is a cross-sectional view of the milling tool shown in FIG. 5, taken along line A-A, but the blades have been removed.

With reference to FIGS. 8 and 9, each blade 18 is housed within a corresponding pocket 20. The pockets 20 are formed around the periphery of the blade housing 12. The pockets 20 are each characterized by first and second side walls 22 and 24 joined by a base 26. Each pocket 20 extends the length of the blade housing 12 and opens on a front surface 28 and an outer surface 30 of the housing 12. Each pocket 20 may be formed at an angle $\alpha$ to a longitudinal axis 41 of the housing 12, as shown in FIG. 9. Because the pockets 20 are formed at an angle within the housing 12, each second side wall 24 is longer than each first side wall 22. The base 26 of each pocket 20 may also be sloped so that the pocket 20 is deeper at the front surface 28 of the housing 12 than at its rear surface 39, as shown in FIG. 9A.

Figure 7:
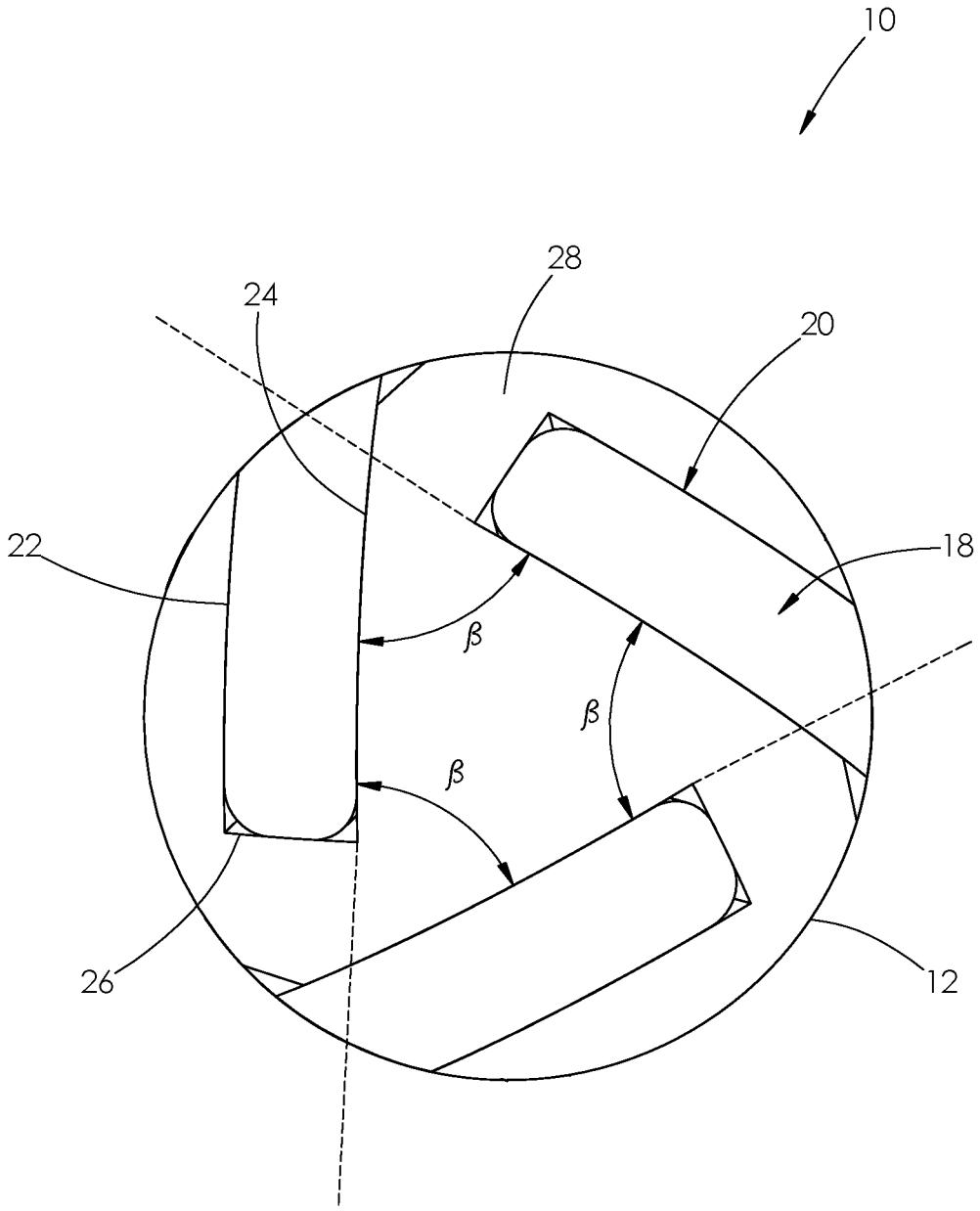
FIG. 7 is the same view of the milling tool as shown in FIG. 4, but the blades are shown in a closed position.

With reference to FIG. 7, each pocket 20 is formed at an angle to an adjacent pocket 20 formed within the blade housing 12. Specifically, the pockets 20 may be formed so that an internal angle β may be measured between adjacent pockets 20. The angle β may be measured by extending the second side wall 24 of each pocket 20 until the second side walls 24 intersect, as shown in FIG. 7. The angles 13 are preferably equal in size. Each of the angles 13 shown in FIG. 7 is approximately 60°.

The milling tool 10 shown in FIGS. 2-7 has three pockets 20. In alternative embodiments, more than three pockets may be formed in the cutter housing. In such case, the size of each angle β may increase so that equal angles are formed between adjacent pockets. In further alternative embodiments, only two pockets may be formed in the housing. In such case, the pockets may be formed parallel to one another.

Figure 5:
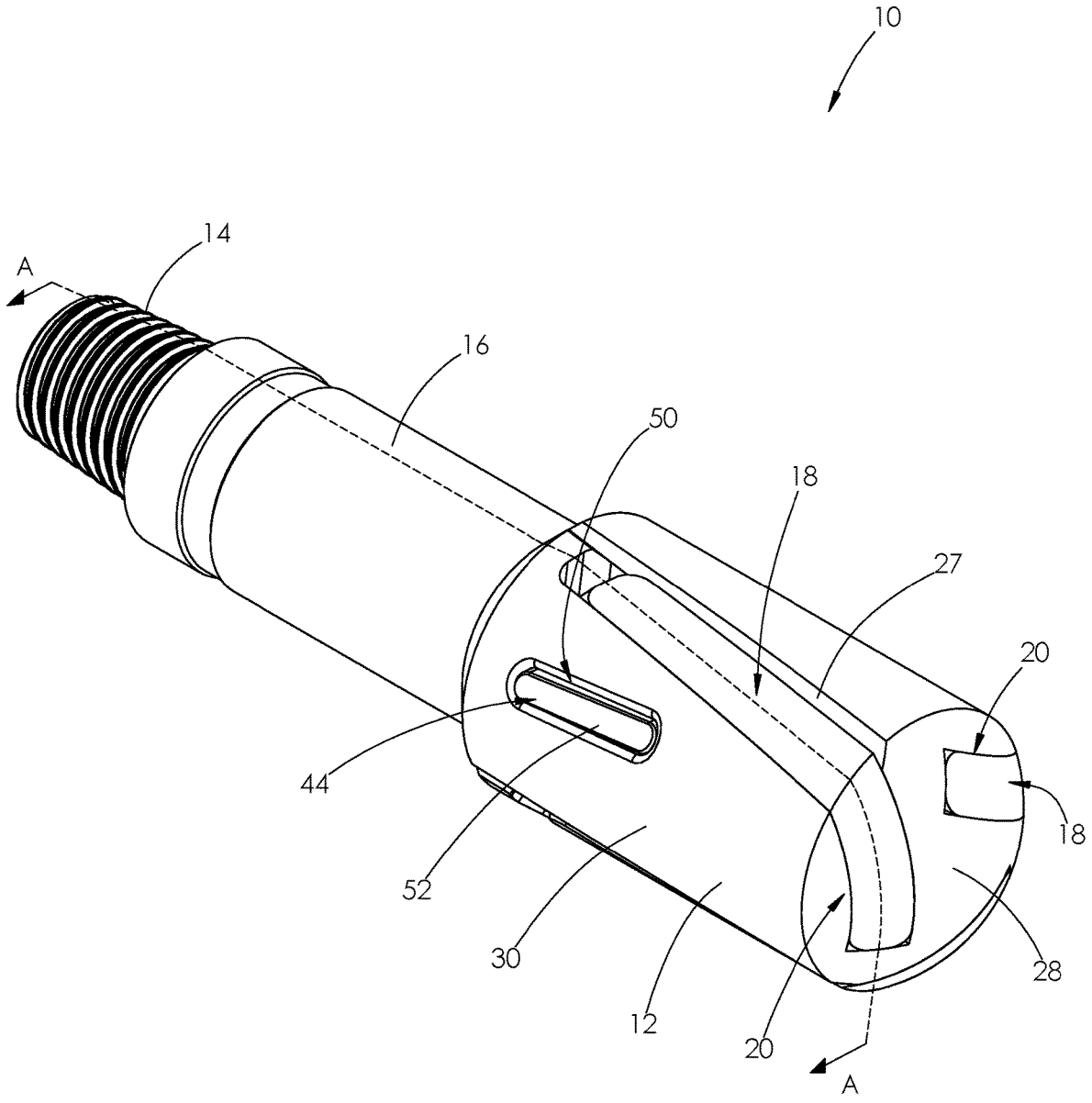
FIG. 5 is the same view of the milling tool as shown in FIG. 2, but the blades are shown in a closed position.

With reference to FIGS. 5 and 8, each blade 18 is sized complementary to that of each pocket 20. When a blade 18 is in a closed position, the outer surface of the blade 18 is flush or mostly flush with the outer surface 30 and front surface 28 of the housing 12. A small bevel 27 may extend between the second side wall 24 of the pocket 20 and the outer surface 30 of the blade housing 12, as shown in FIGS. 5 and 6. The bevel 27 prevents the blade 18 from catching on the side wall 24 as it moves between open and closed positions.

Figure 4:
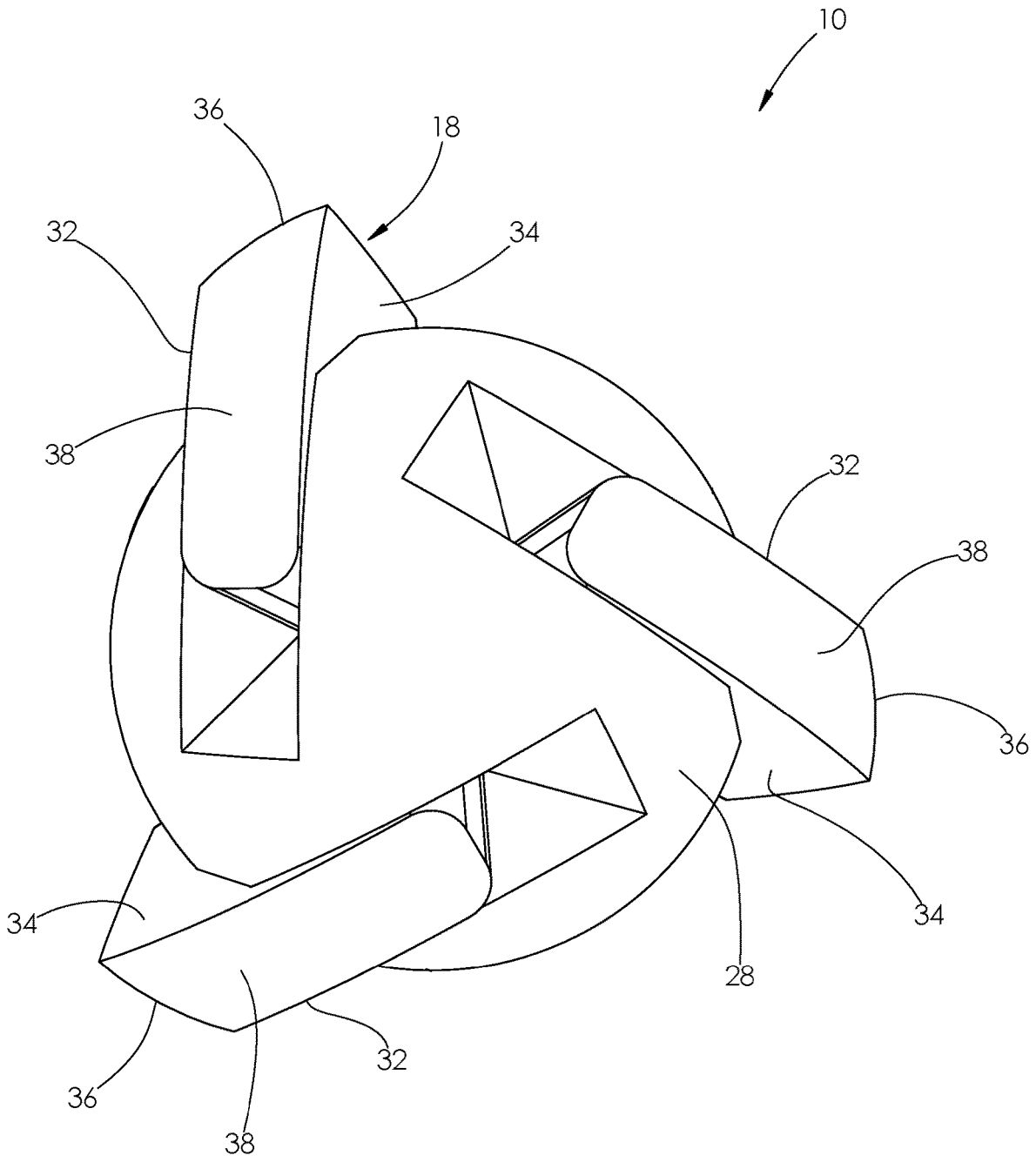
FIG. 4 is a front elevational view of the milling tool shown in FIG. 2.

Turning to FIGS. 4, 8, 10, and 11, each blade 18 has a leading side 32 and an opposed trailing side 34. A rounded top surface 36 and a rounded front surface 38 are formed between each side 32 and 34. The surfaces 36 and 38 are rounded so that they may be flush with the outer and front surfaces 30 and 28 of the housing 12 when the blade 18 is in a closed position, as shown in FIGS. 5-7. When the blades 18 are in an open position and rotating, as shown in FIGS. 2-4, the leading side 32 of each blade 18 will contact the equipment or obstruction to be milled.

A plurality of carbides may be distributed throughout the top surface 36 and front surface 38 of each blade 18. A plurality of carbides may also be distributed throughout the front surface 28 of the housing 12. The carbides help protect the blades 18 and housing 12 and assist in milling the equipment within the casing.

With reference to FIG. 8, a plurality of through-bores 40 are formed in the housing 12 that intersect each pocket 20. Each through-bore 40 aligns with a corresponding counter-bore 42 formed in a second sidewall 24 of each pocket 20. The through-bores 40 and counter-bores 42 are each sized to receive a retention member 44. The retention members 44 are each substantially flat and have the shape of an isosceles trapezoid. In alternative embodiments, the retention members 44 may each be a cylindrical pin or other fastener. In such case, the through-bores and counter-bores may have shapes and sizes complementary to the pin or other fastener.

Figure 10:
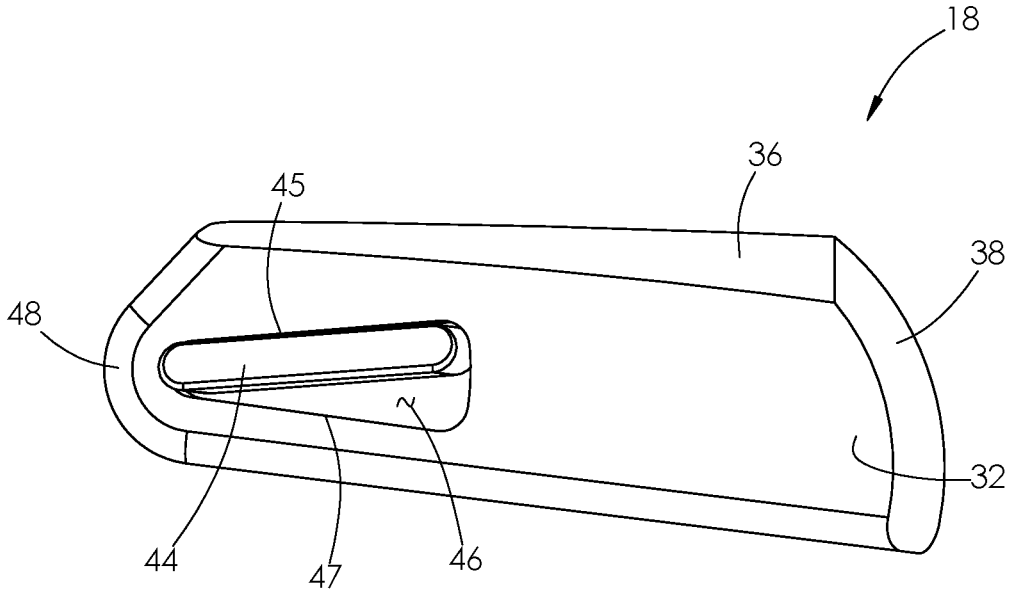
FIG. 10 is a side elevational view of a blade used with the milling tool shown in FIG. 2. A retention member is installed within the blade. The blade is shown in a closed position.
Figure 11:
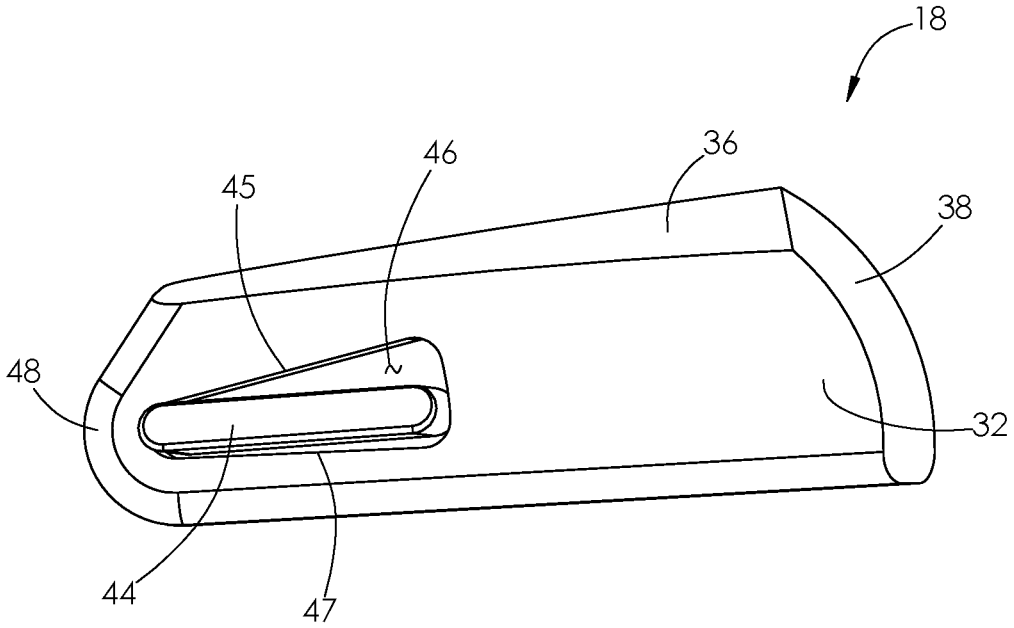
FIG. 11 is the same view of the blade as shown in FIG. 10, but the blade has moved to an open position.

With reference to FIGS. 8, 10 and 11, a passage 46 is formed in each of the blades 18 proximate its rear surface 48. The passage 46 interconnects opposed leading and trailing sides 32 and 34 of each blade 18. The passage 46 has the shape of an isosceles triangle with rounded corners and has a length complementary to the length of the retention member 44. The passage 46 is bounded by upper and lower walls 45 and 47. In alternative embodiments, the passage may have a different shape than that shown in the figures.

Continuing with FIG. 8, when a blade 18 is installed within a pocket 20, a retention member 44 may be installed within a corresponding through-bore 40, the passage 46, and the counter-bore 42. The retention member 44 is preferably press-fit into the counter-bore 42. Once installed, a shallow groove 50 is formed between a top surface 52 of the retention member 44 and the outer surface 30 of the housing 12, as shown in FIG. 5. The groove 50 may be filled with weld or other fusible materials so as to rigidly secure the retention member 44 within the through-bore 40.

Continuing with FIGS. 10 and 11, because the passage 46 is larger than the retention member 44, the blade 18 may rotate relative to the retention member 44. Rotation of the blade 18 relative to the retention member 44 moves the blade between a closed position, as shown in FIG. 10, and an open position, as shown in FIG. 11. When in the open position, the retention member 44 engages the lower wall 47 of the passage 46, as shown in FIG. 11. When in the closed position, the retention member 44 engages the upper wall 45 of the passage 46, as shown in FIG. 10.

Figure 6:
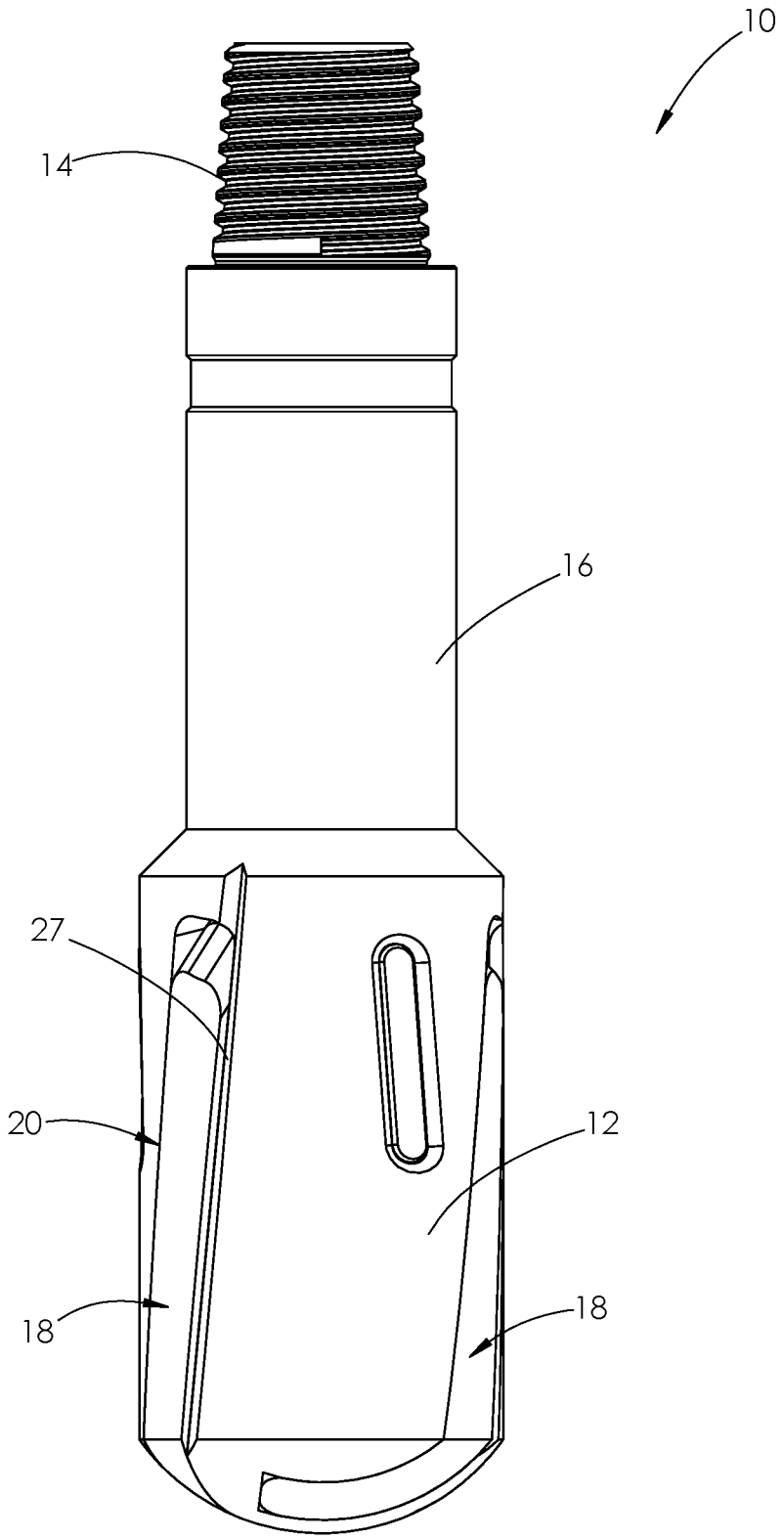
FIG. 6 is the same view of the milling tool as shown in FIG. 3, but the blades are shown in a closed position.

When the milling tool 10 is not rotating, the blades 18 remain in the closed position, as shown in FIGS. 5-7. Once the milling tool 10 starts rotating, the centrifugal force caused by the rotation will move the blades 18 to the open position, as shown in FIGS. 2-4. Once the milling tool 10 stops rotating, the blades 18 may rotate back to the closed position. Gravity or debris between the blade 18 and pocket walls 22 and 24 or the pocket base 26 may prevent one or more of the blades 18 from returning to the closed position. If this occurs a closing force may be applied to the blades 18 as the drill string 21 is pulled back to the ground surface and the blades 18 contact the casing 15.

Figure 12:
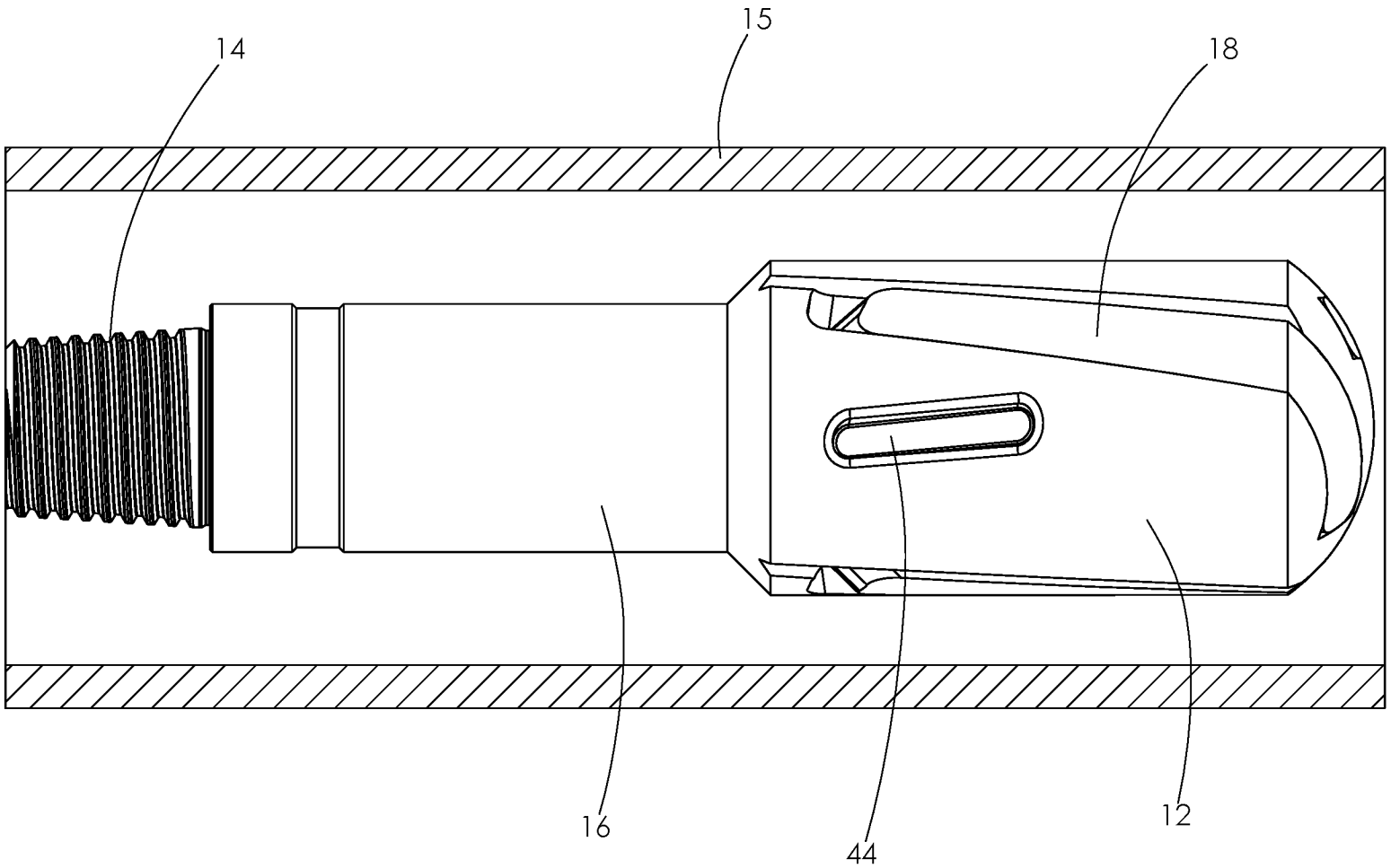
FIG. 12 is a side elevational view of the milling tool shown in FIG. 2 installed within a section of a casing. A portion of the casing has been cut-away to expose the tool. The blades are shown in a closed position.
Figure 13:
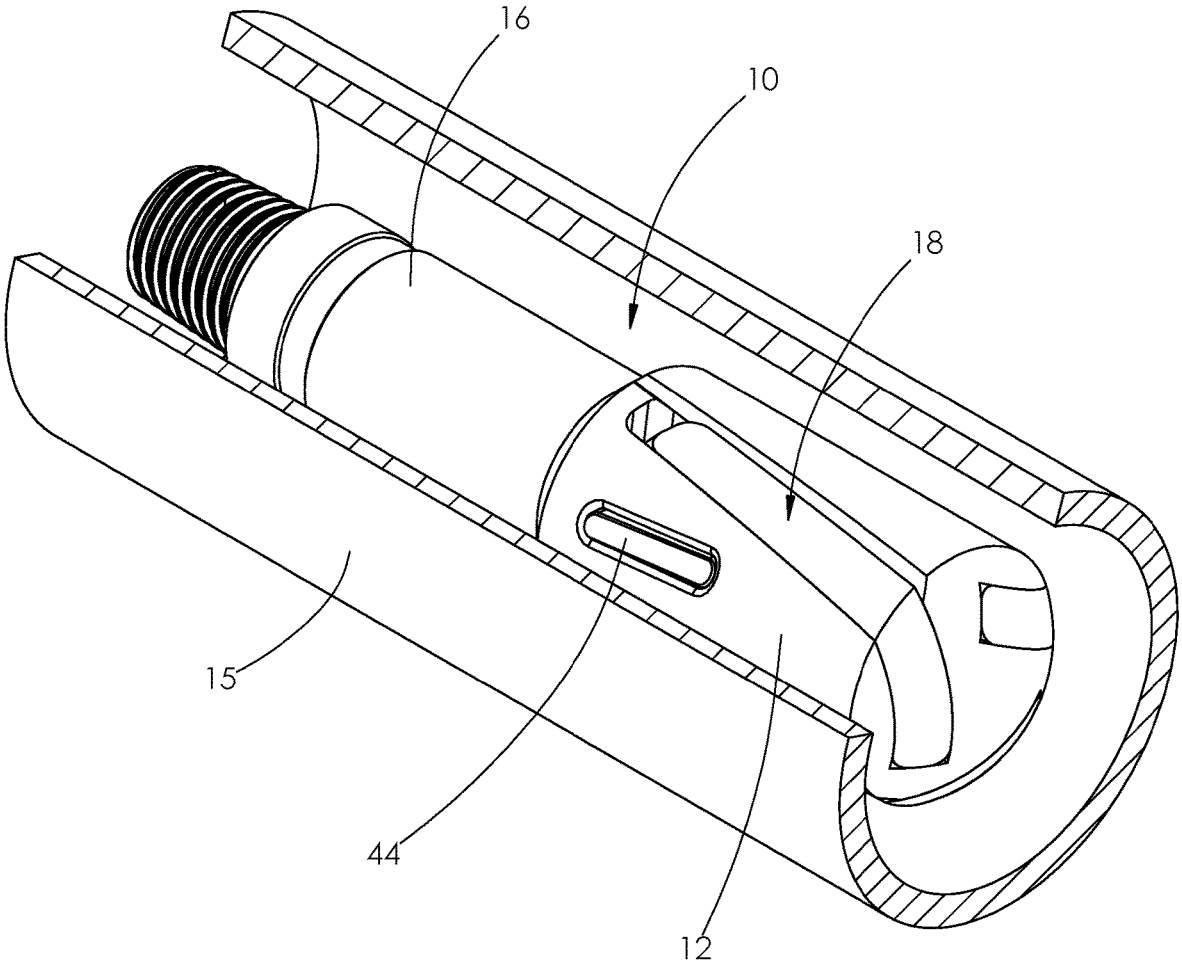
FIG. 13 is a perspective view of the milling tool and casing shown in FIG. 12.
Figure 14:
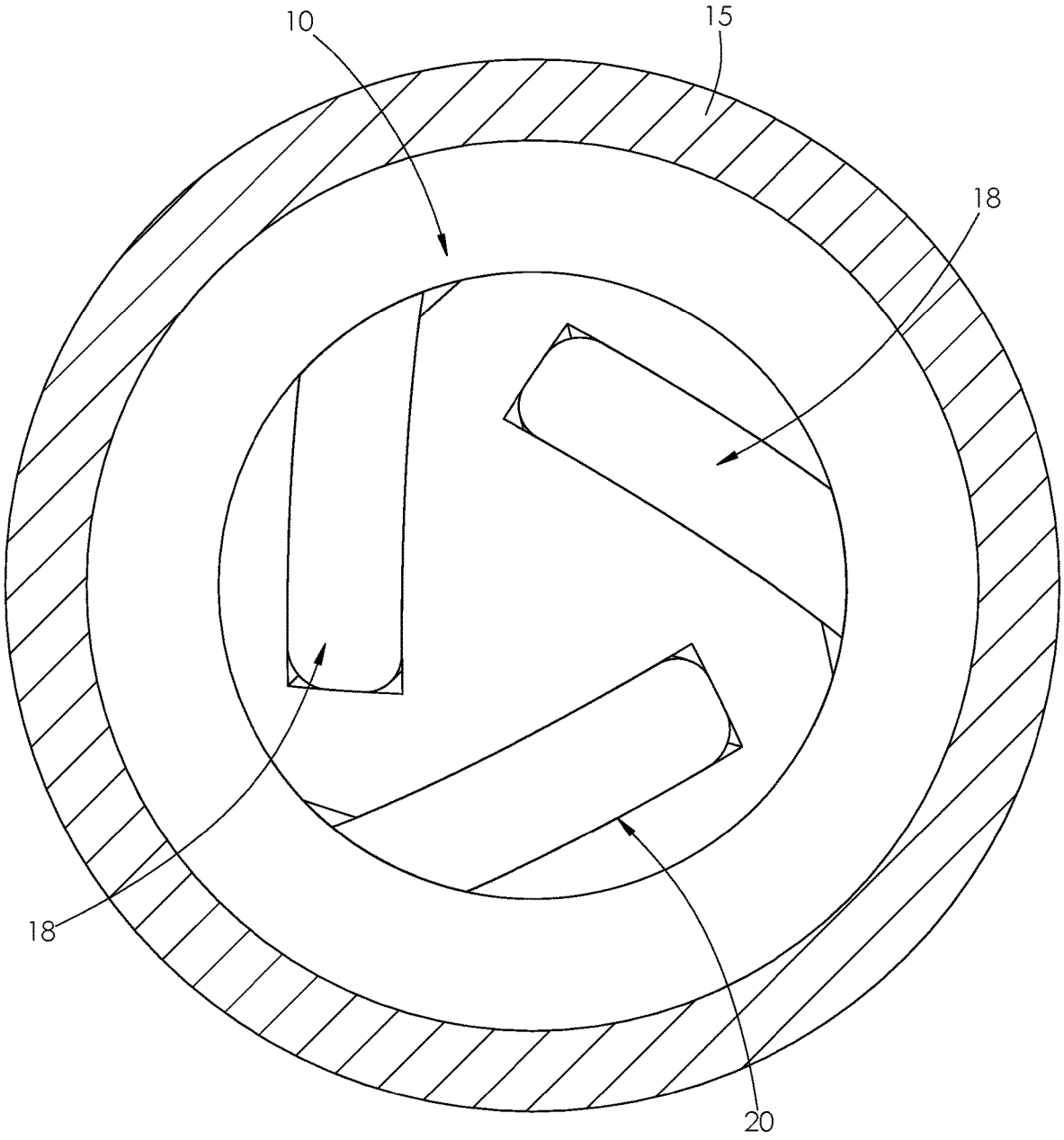
FIG. 14 is a front elevational view of the milling tool and casing shown in FIG. 13, but no side portion of the casing has been cut-away.

With reference to FIGS. 12-14, because the blades 18 may move to a closed position when not rotating, the milling tool 10 can be lowered down the casing 15 without any interference between the casing walls and blades 18. Likewise, the milling tool 10 may be removed from the casing 15 without any interference between the casing wall and the blades 18. The milling tool 10 may also be moved easily around bends or other obstructions within the casing 15 when the blades 18 are in a closed position.

Figure 15:
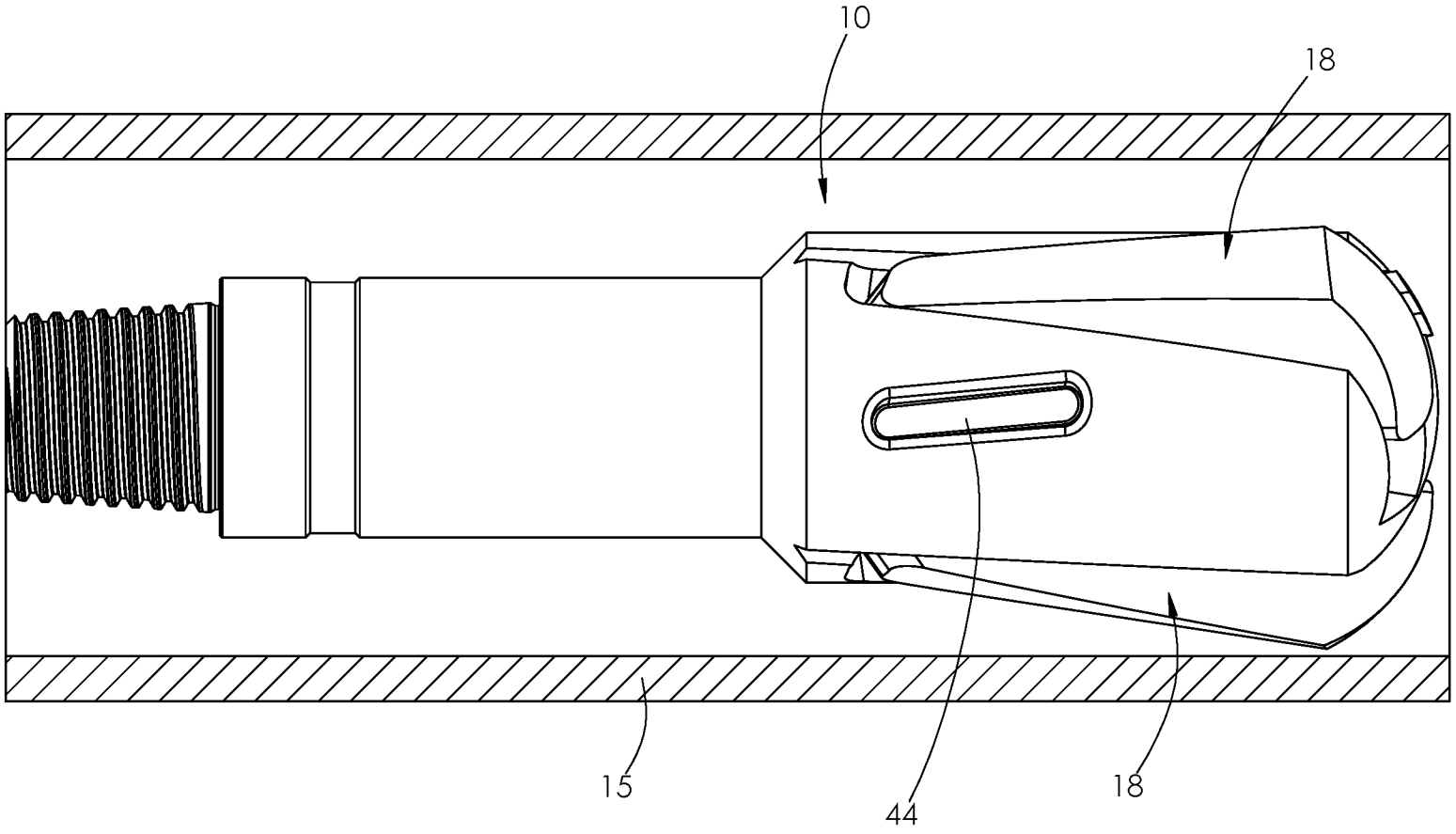
FIG. 15 is the same view of the milling tool and casing as shown in FIG. 12, but the blades are shown in an open position.
Figure 16:
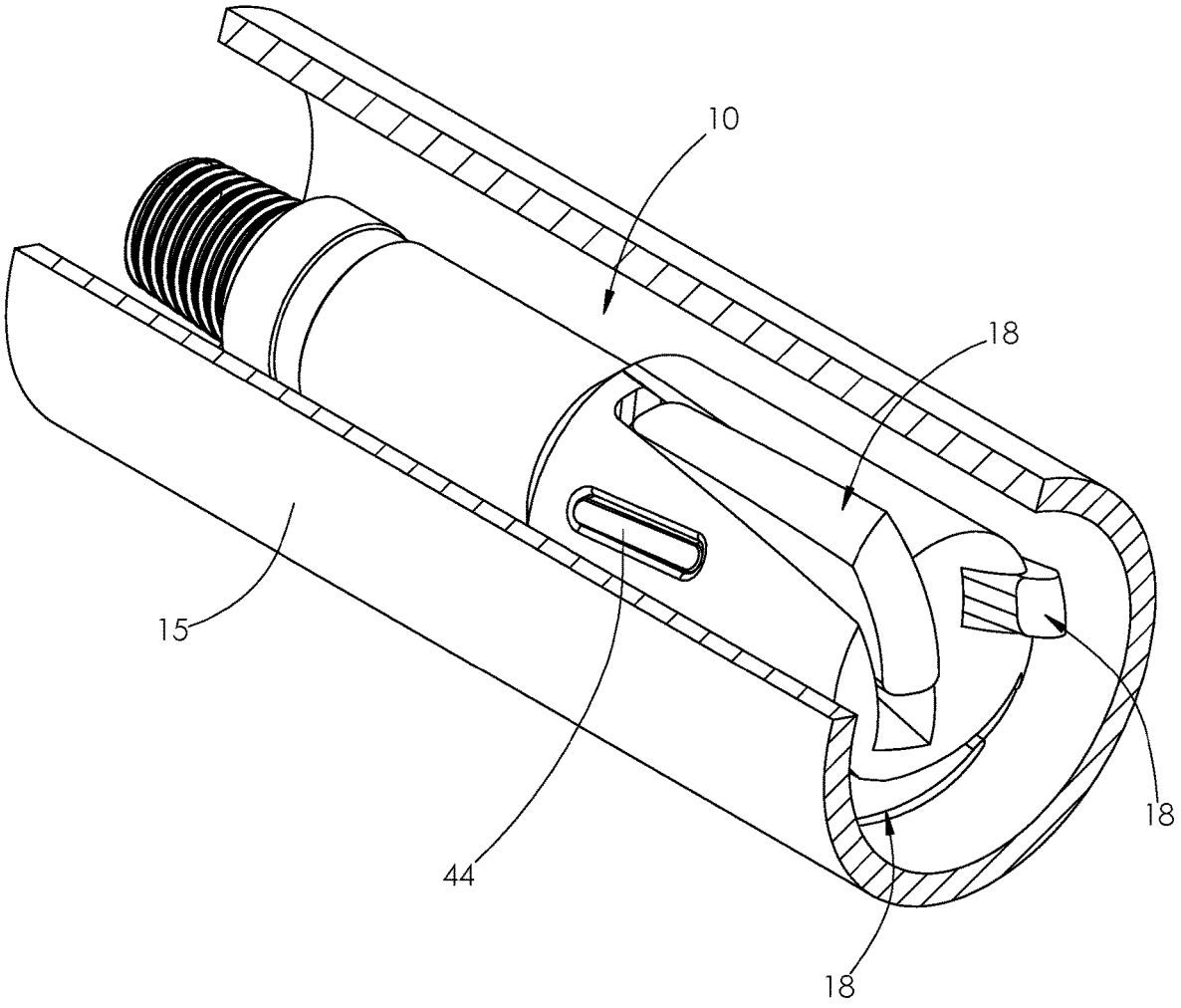
FIG. 16 is the same view of the milling tool and casing as shown in FIG. 13, but blades are shown in an open position.
Figure 17:
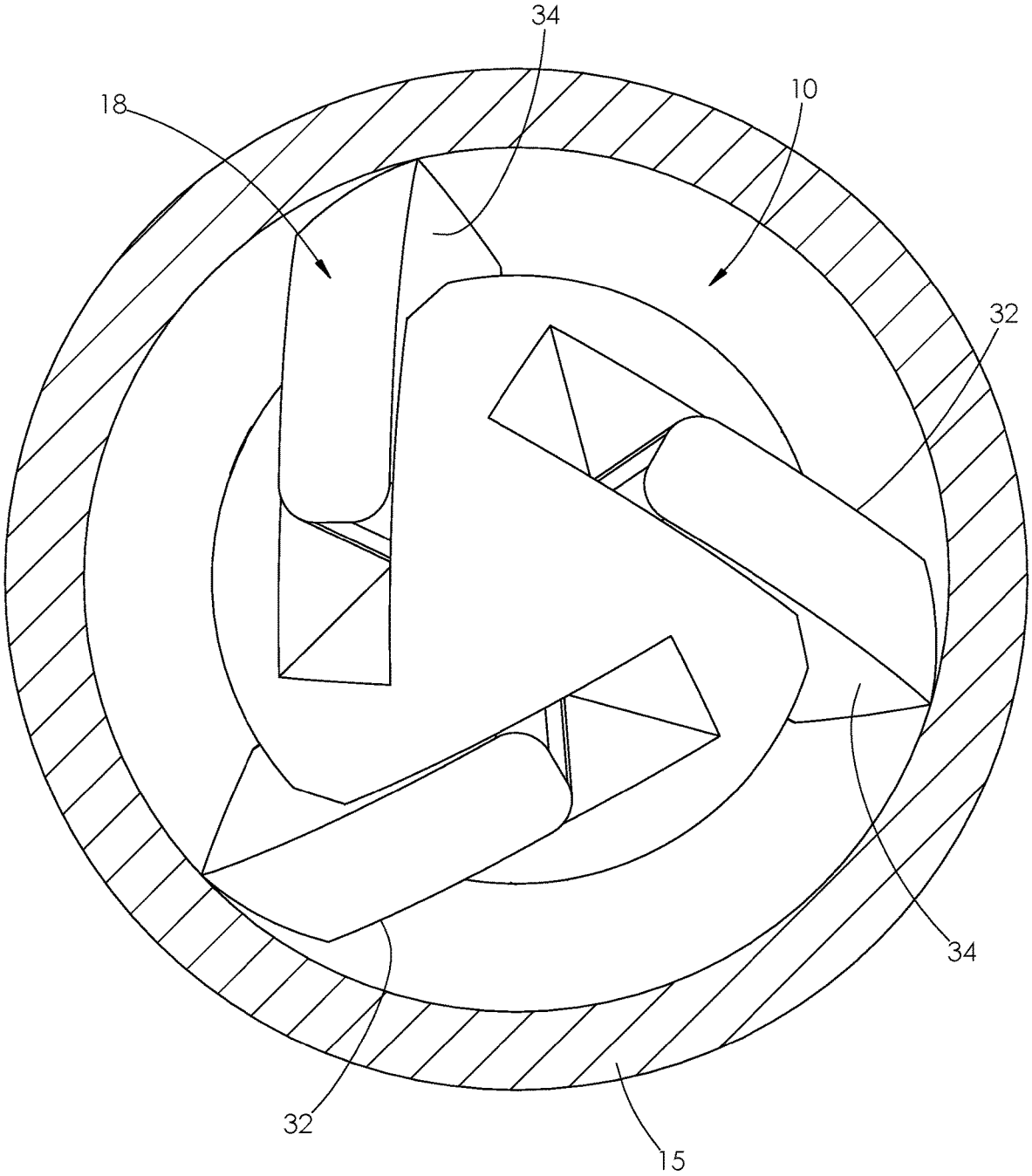
FIG. 17 is the same view of the milling tool and casing as shown in FIG. 14, but the blades are shown in an open position.

With reference to FIGS. 15-17, once the milling tool 10 encounters an object within the casing 15, the downhole motor may start rotating the milling tool 10. The downhole motor may be controlled by fluid pressure delivered to the motor through the work string 21. Rotation of the milling tool 10 causes the blades 18 to move to an open position. When the blades 18 are in an open position, the blades 18 extend to the inner diameter of the casing 15, as shown in FIGS. 15-17. Once the object has been milled up, rotation of the milling tool 10 is stopped, allowing the blades 18 to move back to the closed position.

Changes may be made in the construction, operation and arrangement of the various parts, elements, steps and procedures described herein without departing from the spirit and scope of the invention as described in the following claims.

The invention claimed is:

1. A method of using a system comprising a downhole milling tool, the downhole milling tool comprising:

a housing having an outer surface and at least one pocket formed therein; and a blade installed within the pocket and movable relative to the housing between open and closed positions;

in which the blade projects from the outer surface of the housing when in the open position;

in which the system comprises:

a cased wellbore extending within an underground environment; and an elongate tubular drill string having opposed first and second ends, the first end being situated within the cased wellbore;

in which the downhole milling tool is attached to the first end of the drill string;

in which the method comprises:

lowering the drill string and the downhole milling tool further into the cased wellbore;

rotating the drill string and the downhole milling tool upon encountering an object that is blocking a path of travel of the downhole milling tool, in which rotation of the downhole milling tool causes the blade to move to the open position;

continuing to rotate the drill string and the downhole milling tool until the object no longer blocks the path of the travel of the downhole milling tool;

stopping rotation of the drill string and the downhole milling tool such that the blade moves to the closed position; and lowering the drill string and the downhole milling tool further down the cased wellbore.

* * * * *